US007408516B2

(12) United States Patent
Shih

(10) Patent No.: US 7,408,516 B2
(45) Date of Patent: Aug. 5, 2008

(54) WIRELESS COMMUNICATION DEVICE

(75) Inventor: Yen-Yi Shih, Taipei-Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/611,154

(22) Filed: Dec. 15, 2006

(65) Prior Publication Data

US 2008/0062050 A1 Mar. 13, 2008

(30) Foreign Application Priority Data

Sep. 8, 2006 (TW) ..... 95133278

(51) Int. Cl.
*H01Q 1/24* (2006.01)

(52) U.S. Cl. ..... 343/702; 343/700 MS

(58) Field of Classification Search ..... 343/700 MS, 343/702; 29/600
See application file for complete search history.

(56) References Cited

U.S. PATENT DOCUMENTS

| | | | | |
|---|---|---|---|---|
| 7,091,910 | B2 | 8/2006 | Liang et al. | |
| 7,256,741 | B2 * | 8/2007 | Wen et al. | 343/700 MS |
| 2004/0036653 | A1 * | 2/2004 | Ishihara et al. | 343/700 MS |
| 2006/0244665 | A1 * | 11/2006 | Tung | 343/702 |
| 2007/0152894 | A1 * | 7/2007 | Sanz et al. | 343/702 |

* cited by examiner

*Primary Examiner*—Tan Ho
(74) *Attorney, Agent, or Firm*—Wei Te Chung

(57) ABSTRACT

A wireless communication device (10) includes a dielectric base (50), a circuit board (70), an antenna (30), and a case (20). The dielectric base includes a first surface (508), a second surface (509) opposite to the first surface, a plating area (502), and a non-plating area (504). The plating area and the non-plating area are disposed on the first surface. The circuit board is disposed on the second surface. The antenna is plated on the plating area by a plating process. The circuit board and the dielectric base are received in the case.

19 Claims, 3 Drawing Sheets

WIRELESS COMMUNICATION DEVICE

BACKGROUND OF THE INVENTION

1. Field of the Invention

The present invention pertains to wireless communication devices, and particularly to a wireless communication device with an antenna formed by a plating/electroplating process.

2. Description of Related Art

Wireless communication devices such as mobile telephones, personal digital assistants, and hand-held scanners having wireless communication capabilities are currently available in several different forms. In these wireless communication devices, antennas are used for transceiving electromagnetic wave signals, and thus the antennas in these electronic devices are necessary.

Referring to FIG. 3, an isometric view of a conventional wireless communication device 90 is shown. The wireless communication device 90 comprises a tridimensional antenna 92, a dielectric base 94, a circuit board 96 and a connecting portion 98. The tridimensional antenna 92 is disposed on one side of the dielectric base 94. The circuit board 96 is disposed on another side of the dielectric base 94. The connecting portion 98 electrically connects to the antenna 92 and the circuit board 96. The antenna 92 may be stamped from a metal plate.

However, the above fabricating process results in a thickness of the antenna 92 and a length of the connecting portion 98 requires excess space D under mechanical constraint, thus increasing space requirements preventing efforts to further reduce the size of the wireless communication device 90. Besides, it costs much when the antenna is necessary to be separately made.

Therefore, a heretofore unaddressed need exists in the industry to overcome the aforementioned deficiencies and inadequacies.

SUMMARY OF THE INVENTION

In an exemplary embodiment, a wireless communication device includes a dielectric base, a circuit board, an antenna, a lower cover, and an upper cover. The dielectric base includes a first surface, a second surface opposite to the first surface, a plating area, and a non-plating area. The plating area and the non-plating area are disposed on the first surface. The circuit board is disposed on the second surface. The antenna is plated on the plating area by a plating process. The upper cover is mounted to the lower cover. The upper cover and the lower cover cooperatively define a receiving space for receiving the circuit board and the dielectric base.

In another exemplary embodiment, a wireless communication device includes a dielectric base, a circuit board, a case, and an antenna. The circuit board is disposed on the dielectric base. The case is used for receiving the circuit board and the dielectric base, and includes a lower cover. The lower cover includes an inner surface, a plating area, and a non-plating area. The plating area and the non-plating area are disposed on the inner surface. The antenna is plated on the plating area by a plating process.

Other advantages and novel features will become more apparent from the following detailed description of preferred embodiments when taken in conjunction with the accompanying drawings, in which:

DETAILED DESCRIPTION OF THE INVENTION

Figure 1:
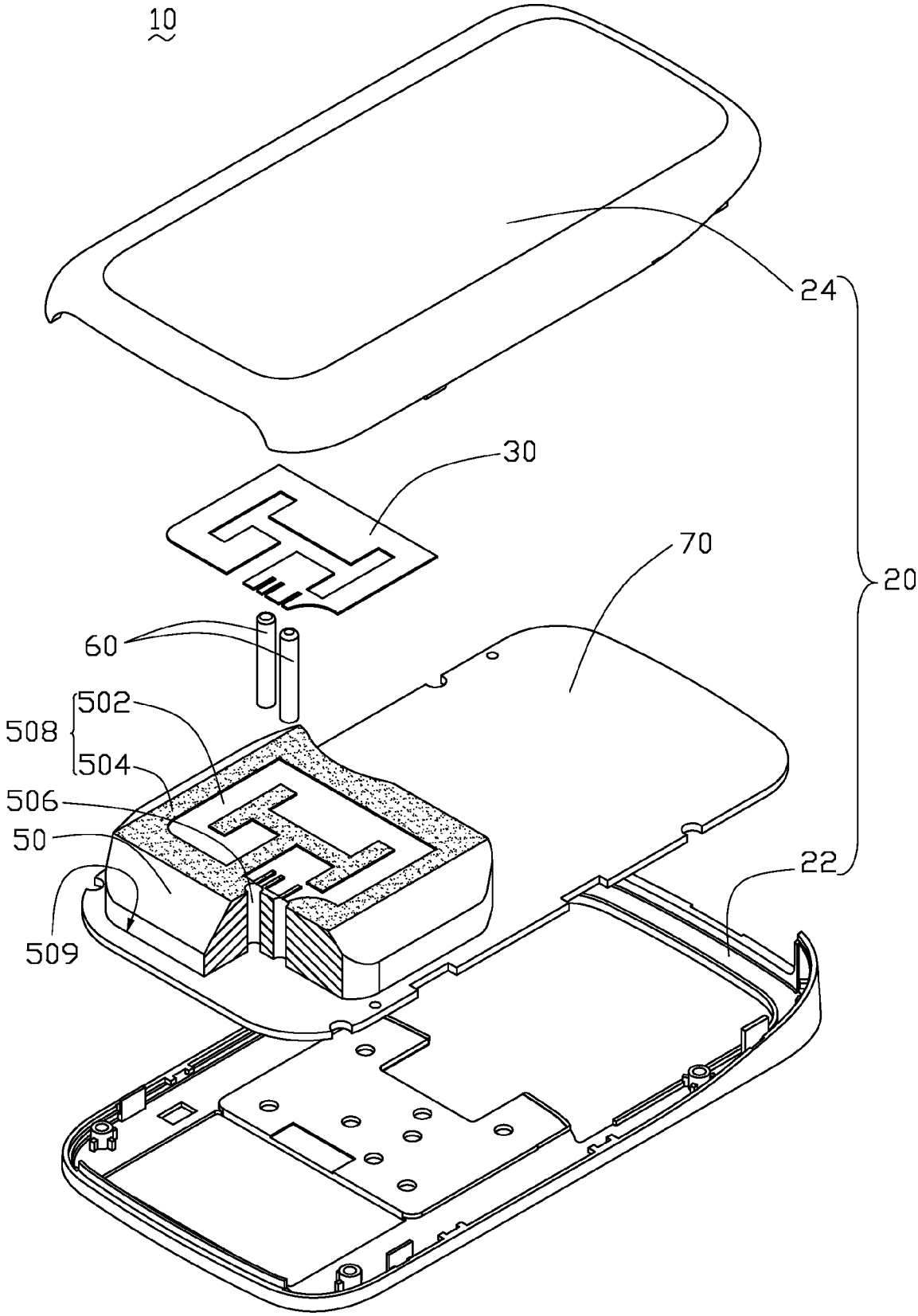
FIG. 1 is an exploded, isometric view of a wireless communication device in accordance with an exemplary embodiment of the present invention.

Referring to FIG. 1, a wireless communication device 10 of an exemplary embodiment of the present invention comprises a dielectric base 50 of an electronic component, a circuit board 70, an antenna 30, a case 20, and a pair of conductive pins 60. In the exemplary embodiment, the wireless communication device 10 is a mobile telephone, and the electronic component having the base 50 is a surface acoustic module (SAM) for the mobile telephone.

The case 20 comprises an upper cover 22 and a lower cover 24. The lower cover 24 is mounted to the upper cover 22. The dielectric base 50 and the circuit board 70 are received in the case 20. The dielectric base 50 comprises a first surface 508, a second surface 509, a plating area 502, and a non-plating area 504. The second surface 509 is opposite to the first surface 508. The plating area 502 and the non-plating area 504 are disposed on the first surface 508. The non-plating area 504 is masked with paint for preventing the non-plating area 504 from being plated. A shape of the plating area 502 is the same as that of the antenna 30. The antenna 30 is plated/electroplated on the plating area 502 by a plating process. The dielectric base 50 further comprises a pair of receiving portions 506. The receiving portions 506 extend through the first surface 508 and the second surface 509 thereof. Each conductive pin 60 is received in the corresponding receiving portion 506, and connects to the antenna 30 and the circuit board 70 for transferring electromagnetic wave signals. The circuit board 70 is disposed on the second surface 509. The dielectric base 50 is molded from a plateable plastic material. The plateable plastic material for the dielectric base can be ABS (acrylonitrile-butadiene-styrene terpolymer), or combination of ABS and PC (Polycarbonate). However, any other material or combination of materials providing a like function as disclosed herein may alternatively be employed. In this exemplary embodiment, the dielectric base 50 is made of ABS.

With the antenna 30 of the wireless communication device 10 being plated/electroplated on the plating area 502 of the dielectric base 50 to form a film antenna 30 by a plating process, the antenna 30 has the same shape as the plating area 502, and the antenna 30 firmly abuts against the dielectric base 50. Therefore, the antenna 30 can be easily manufactured even though the antenna 30 has a complicated structure. In addition, the film antenna 30 is thin, thus reducing space requirements and making the wireless communication device 10 more compact.

Figure 2:
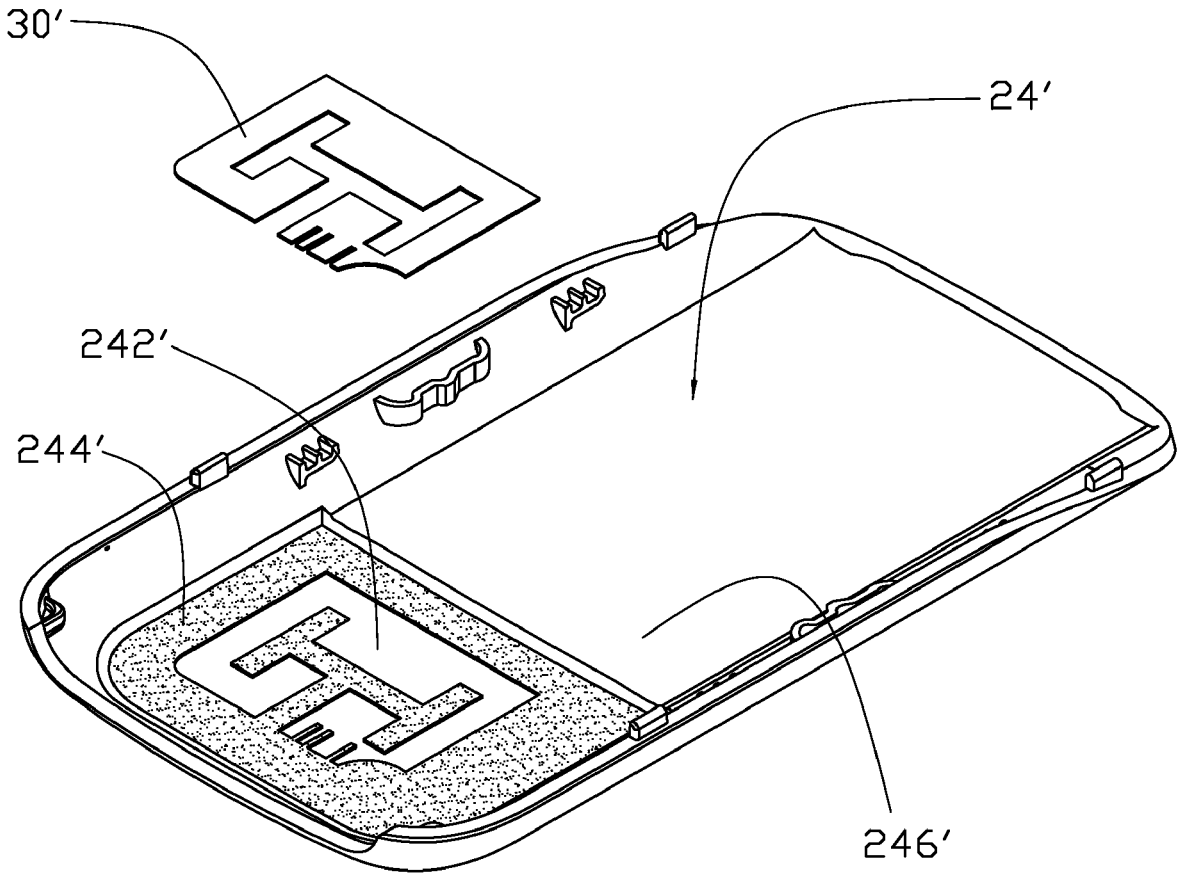
FIG. 2 is an isometric view of an antenna and a lower cover of the wireless communication device in accordance with an alternative exemplary embodiment of the present invention.
Figure 3:
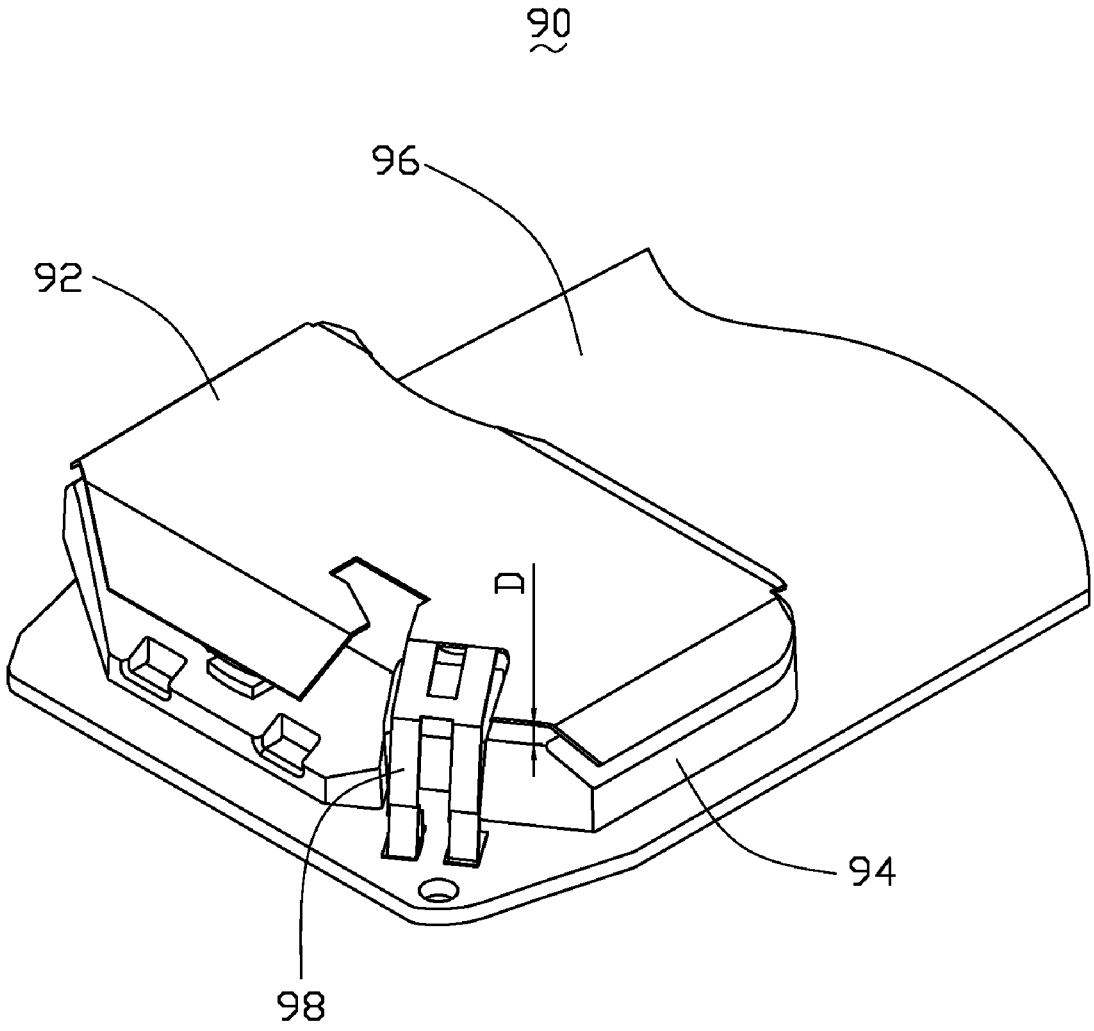
FIG. 3 (PRIOR ART)
FIG. 3 is an assembled, isometric view of a conventional wireless communication device.

In an alternative exemplary embodiment, referring to FIG. 2, the lower cover 24' has a similar structure as the lower cover 24 shown in FIG. 1. However, in the exemplary embodiment, the difference is that the plating area 242' and the non-plating area 244' are disposed on an inner surface 246' of the lower cover 24'. The antenna 30' is plated on the plating area 242'. The conductive pins 60 of FIG. 1 electrically connect to the antenna 30' and the circuit board 70 of FIG. 1.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A wireless communication device, comprising:

a dielectric base comprising a first surface, a second surface opposite to the first surface, a plating area, and a non-plating area, the plating area and the non-plating area being disposed on the first surface;

a circuit board disposed on the second surface;

an antenna plated on the plating area by a plating process; and a case for receiving the circuit board and the dielectric base.

2. The wireless communication device as claimed in claim 1, wherein the non-plating area is masked with paint for preventing the non-plating area from being plated.

3. The wireless communication device as claimed in claim 1, wherein the dielectric base is molded from a plateable plastic material.

4. The wireless communication device as claimed in claim 1, wherein the dielectric base further comprises at least one receiving portion extending through the first surface and the second surface thereof.

5. The wireless communication device as claimed in claim 4, further comprising at least one conductive pin received in a corresponding one of the at least one receiving portion, the conductive pin electrically connecting the antenna and the circuit board.

6. The wireless communication device as claimed in claim 5, wherein the at least one receiving portion comprises a pair of receiving portions.

7. The wireless communication device as claimed in claim 5, wherein the at least one conductive pin comprises a pair of conductive pins.

8. The wireless communication device as claimed in claim 1, wherein the wireless communication device is a mobile telephone.

9. A wireless communication device, comprising:

a dielectric base;

a circuit board disposed on the dielectric base;

a case for receiving the circuit board and the dielectric base, the case comprising a lower cover comprising an inner surface, a plating area, and a non-plating area, the plating area and the non-plating area are disposed on the inner surface; and an antenna plated on the plating area by a plating process.

10. The wireless communication device as claimed in claim 9, wherein the non-plating area is masked with paint for preventing the non-plating area from being plated.

11. The wireless communication device as claimed in claim 9, wherein the lower cover is molded from a plateable plastic material.

12. The wireless communication device as claimed in claim 9, wherein the dielectric base further comprises at least one receiving portion extending therethrough.

13. The wireless communication device as claimed in claim 12, further comprising at least one conductive pin received in a corresponding one of the at least one receiving portion, the conductive pin electrically connecting the antenna and the circuit board.

14. The wireless communication device as claimed in claim 13, wherein the at least one receiving portion comprises a pair of receiving portions.

15. The wireless communication device as claimed in claim 13, wherein the at least one conductive pin comprises a pair of conductive pins.

16. The wireless communication device as claimed in claim 9, wherein the case further comprises an upper cover mounted to the lower cover.

17. The wireless communication device as claimed in claim 9, wherein the wireless communication device is a mobile telephone.

18. A wireless communication device, comprising:

a case enclosing said wireless communication device, comprising a cover to shield a side of said wireless communication device;

a circuit board disposed in said case and spaced from said cover of said cover of said case;

a dielectric base of an electronic component of said wireless communication device disposed and located between said circuit board and said cover to space said circuit board from said cover; and an antenna disposed between said base of said electronic component and said cover of said case, and being electroplated on a plating area defined on a selective one of said base of said electronic component and said cover of said case by means of an electroplating process.

19. The wireless communication device as claimed in claim 18, further comprising a conductive pin extending inside and through said base of said electronic component to electrically connect said antenna with said circuit board.

* * * * *